US005784914A

United States Patent [19]

Ciani

[11] Patent Number: 5,784,914

[45] Date of Patent: Jul. 28, 1998

[54] METHOD TO CONTROL BETWEEN ROLLING STANDS THE DRAWING OF THE ROLLED STOCK AND RELATIVE DEVICE

[75] Inventor: Lorenzo Ciani, Udine, Italy

[73] Assignee: Ceda SpA Costruzioni Elettromeccaniche e Dispositivie d'Automazione, Buttrio, Italy

[21] Appl. No.: 691,798

[22] Filed: Aug. 2, 1996

[30] Foreign Application Priority Data

Aug. 3, 1995 [IT] Italy ..... UD95A0152

[51] Int. Cl.[6] ..... B21B 39/08

[52] U.S. Cl. ..... 72/205; 72/8.6; 72/11.4; 72/12.3

[58] Field of Search ..... 72/710, 205, 206, 72/227, 234, 8.3, 8.6, 8.7, 11.1, 11.4, 12.3, 12.6, 14.4, 31.08, 31.13, 20.1

[56] References Cited

U.S. PATENT DOCUMENTS

| | | | |
|---|---|---|---|
| 1,341,651 | 6/1920 | Lammers . | |
| 4,535,614 | 8/1985 | Oka | 72/205 |
| 4,549,420 | 10/1985 | Cloostermans-Huwaert | 72/206 |
| 4,607,511 | 8/1986 | Shore . | |
| 4,665,730 | 5/1987 | Maroti | 72/205 |

FOREIGN PATENT DOCUMENTS

| | | | |
|---|---|---|---|
| 219316 | 4/1987 | European Pat. Off. . | |
| 290834 | 11/1988 | European Pat. Off. . | |
| 58-35013 | 3/1983 | Japan | 72/205 |
| 58-50119 | 3/1983 | Japan | 72/20.1 |
| 59-223108 | 12/1984 | Japan | 72/205 |
| 0799853 | 1/1981 | U.S.S.R. | 72/710 |
| 0852397 | 8/1981 | U.S.S.R. | 72/710 |
| 1391760 | 4/1988 | U.S.S.R. | 72/710 |
| 1488041 | 6/1989 | U.S.S.R. | 72/710 |
| 1547911 | 3/1990 | U.S.S.R. | 72/710 |
| 1616744 | 12/1990 | U.S.S.R. | 72/710 |
| 1043556 | 9/1966 | United Kingdom . | |

OTHER PUBLICATIONS

Patent Abstracts of Japan, vol. 16, No. 314 (M-1278) Jul. 9, 1992 & JP-A-04 089124 (Daido Steel Co. Ltd.) 23 Mar. 1992 Abstract.

Patent Abstracts of Japan, vol. 8, No. 80 (M-289) 12, Apr. 1984 & JP-A-58 224018 (Kobe Seikosho K.K.) Dec. 1983 Abstract.

Patent Abstracts of Japan, vol. 9, No. 235 (M-415), Sep. 21, 1985 & JP-A-60 092009 (Toshiba) 23 May 1985—Abstract.

*Primary Examiner*—Lowell A. Larson
*Assistant Examiner*—Ed Tolan
*Attorney, Agent, or Firm*—Antonelli, Terry, Stout & Kraus, LLP

[57] ABSTRACT

A method of controlling and maintaining a drawing force applied to a length of rolled stock between two-spaced apart rolling units includes the steps of determining the value of at least one of a frequency and an amplitude of a transversed vibration of the rolled stock between the drawing units, correlation of the determined value to a corresponding value of drawing force, comparison of the correlated value of the drawing force to a reference value, and adjustment of the drawing force to maintain it at a substantially constant selected value. In another aspect of the invention an apparatus is provided which includes elements for measuring at least one of a frequency and an amplitude of a traversed vibration experienced by a length of rolled stock between two drawing units, a unit for correlating the measured value to a corresponding value of applied drawing force, and a control unit for adjusting the applied drawing force as necessary to maintain it substantially at a selected constant value.

13 Claims, 2 Drawing Sheets

METHOD TO CONTROL BETWEEN ROLLING STANDS THE DRAWING OF THE ROLLED STOCK AND RELATIVE DEVICE

BACKGROUND OF THE INVENTION

This invention concerns a method to control between rolling stands the drawing of the rolled stock and a device which performs such method.

The invention can be applied substantially to any type of rolling and/or finishing process for the purpose of controlling and adjusting the drawing action applied to the rolled stock so as to avoid the formation of critical points and/or deformations along the rolled stock caused by an excessive and/or not uniform and/or not constant drawing action in the long term.

In particular, the invention enables the deformations and reductions of the cross-section of the material to be avoided which could lead to the material not conforming to the finished tolerance of the product and could lead to the obtaining of a finished product having unacceptable characteristics of quality.

One of the great problems encountered in hot-rolling processes, particularly in the production of long products and in plants where the rolling is carried out directly in line with the casting, is linked to the necessity of maintaining a substantially constant drawing force being applied to the rolled stock between the rolling stands so as to avoid the formation on the rolled product of distributed critical points due to deformations and reductions of the cross-section of the material.

These deformations and reductions spread along the rolled product and affect in a non-uniform manner the segment of material between two rolling stands and/or between a rolling stand and the drawing unit associated therewith.

This can cause an unacceptable deterioration of quality in the material and, sometimes, the necessity of discarding a great quantity of product which does not meet the standards of quality required by the market.

This problem is especially great in rolling plants including finishing trains in which a fast cooling and possible temperature-equalisation line is included at least upstream of the last fast rolling unit.

This cooling line has the purpose of carrying out a treatment of a thermomechanical type on the rolled product upstream of the last finishing pass so that the last fast rolling unit can act on colder material and can thus achieve technological and qualitative advantages from the treatment.

This type of process accentuates the above problems due to an irregular and non-uniform drawing action inasmuch as the rolled product in the segment between stands or between a stand and the relative drawing unit includes portions at temperatures which may even be very different.

In particular, the rolled product has a portion upstream of the cooling unit which is hotter and more subject to the consequences of this type of mechanical stresses caused by a drawing action which is not constant and not uniform.

In the state of the art, to solve this problem various methods and devices to control the drawing of the rolled stock between stands have been proposed, but they have given only partial results, not always satisfactory as far as the accuracy and constancy of the results are concerned.

For example, U.S. Pat. No. 4,607,511 teaches that the drawing of the rolled stock between stands is controlled by using a device to measure the diameter of the rolled stock in transit, the device being placed downstream of the rolling stands between which the control must be made.

When there is a deviation from the planned nominal diameter, as revealed by the diameter measuring device, a control unit intervenes and modifies the rotation speed of the rollers so as to modify the drawing action exerted by the rollers and thus reestablish the correct rolling conditions.

The document U.S. Pat. No. 511 also teaches to measure the diameter of the rolled stock upstream of the stands whose drawing action has to be controlled, so as to make the adjustments and interventions of the control unit quicker.

The diameter measurement means arranged upstream and downstream of the rolling blocks makes it possible to detect deviations from the nominal diameter as programmed at the outlet of the rolling blocks, but they do not make it possible to identify how much of this deviation is derived from an incorrect drawing action between the stands, in proportion to the total deviations detected.

This method of controlling the drawing action is therefore extremely influenced and able to be influenced by the working characteristics of the rolling rolls and by all the parameters which can influence the correct definition of the thickness of the rolled stock as it comes out of the block.

The document EP-A-219.316 describes a method to control the drawing of the rolled stock between stands which uses a pinch-roll drawing device arranged between two rolling blocks.

This method is based on a continual control of the portion of the rolled stock in the segment between the stands with respect to the initial setting parameters defined as the material enters the stand.

According to this verification, and keeping constantly under control the speed of the rollers of the two rolling blocks and the pinch-roll in between, a control unit intervenes to adjust at least the speed of the rollers of the rolling block downstream in order to reestablish the correct conditions if there are unacceptable deviations.

This method, as it provides a periodic control and comparison with parameters defined with conditions prevailing when the rolled stock enters the stand, cannot be used in the case of rolling and casting in line and therefore its field of application is limited specifically to the case of conventional discontinuous rolling of billets; moreover, it has been shown to be imprecise and inconstant in the results it gives.

The document JP-A-089-124 describes a method to control the tension by means of detecting, at a defined point of the segment between the stands, the dimensional pulsations of the portion of rolled stock which are caused by yields in the material caused by an excessive drawing action, the pulsations being recorded by a diameter measuring device.

If the dimensional pulsations exceed a tolerated level, JP'124 teaches to intervene on the rotation speed of the rollers of the downstream stand in order to reestablish the correct rolling conditions.

The document GB-A-1.043.556 includes a device between the stands to control the tension of the rolled stock passing through, continually controlling the transverse dimension.

SUMMARY OF THE INVENTION

The present applicants have designed, tested and embodied this invention to overcome the shortcomings of the state of the art and to achieve further advantages.

The purpose of the invention is to provide a method and the relative device to measure the drawing force being applied to the rolled product in the segment between rolling stands in a rolling line, advantageously but not necessarily applied in plants where the rolling line is placed in line with the continuous casting machine.

This invention can be applied at an intermediate position between two conventional rolling stands, between two rolling stands between which is located a drawing unit, between a rolling stand and the relative drawing unit, between a rolling stand and a fast rolling unit, between two fast rolling units with or without an intermediate thermomechanical treatment, and in any other suitable situation in which a rolled product is drawn between two or more processing units.

The invention is particularly suitable in the case of two fast rolling blocks, which are respectively a fast semi-finishing block and a fast finishing block, in a finishing train which includes an intermediate cycle of thermo-mechanical treatment.

The invention arranges to act on the working parameters of the processing units which exert the drawing force,i.e., a tension force, on the rolled stock if, according to the measurement of a definite portion of the rolled stock placed between the two units, it is found that the drawing force itself exceeds the desired limits and/or induces in the rolled stock longitudinal deformations which exceed pre-set limit values.

The invention comprises at least one measurement device able to measure the value of the drawing force exerted on the rolled stock.

This measurement device is associated with a control unit which acts in feedback on the working parameters of the downstream and/or upstream processing units so as to keep this drawing action within pre-set limits.

According to the invention, an action of an impulse type is induced on the rolled stock as it passes through, which causes a transverse vibration and/or oscillation according to specific parameters of frequency and amplitude.

In particular, the application of an impulse to the rolled stock travelling at high speed causes a transverse oscillation of the rolled stock at least according to a characteristic frequency whose value is correlated to the state of tension of the rolled stock, i.e., the magnitude of the tension force experienced by the rolled stock at the moment when the impulse-type action is exerted.

The parameters of frequency and amplitude of the oscillation are measured by suitable detecting means, and are then used to determine, and if necessary correct, the value of the drawing action in the segment between stands.

In this case a drawing unit is included downstream and advantageously at a position in the vicinity of these detecting means and is able to define a precise determination of the length of the rolled stock on which this vibration is induced.

The drawing unit is also able to maintain in the right direction the portion of rolled stock which is being measured, so as to to avoid contact of the rolled stock with guide means or containing means.

In this way the vibration induced is not influenced by any other factor, and this allows a precise measurement to be obtained, which is not distorted by undesired external factors.

In one embodiment of the invention this impulse action is of an electromechanical type and is obtained by a generator of an impulse field associated peripherally with the rolled stock.

According to a variant, this impulse action is of a mechanical type and is obtained by applying an impact directly to the rolled stock passing through.

According to another variant, the impact which causes the vibration of the rolled stock is applied on the rolling stand or stands or on the drawing unit or units cooperating with the passage of the rolled stock.

According to another variant of the invention, no impulse action is induced on the rolled stock as it passes through, but the frequency and amplitude of the vibration of the portion of rolled stock is measured between the upstream stand and the drawing unit in order to obtain the measurement of the drawing action exerted on the rolled stock.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

The reference number 10 in the attached figures denotes a segment of a rolling line comprising at least one conventional rolling stand 23*a*, 23*b* or at least one fast rolling block 11*a*, 11*b*.

Figure 1:
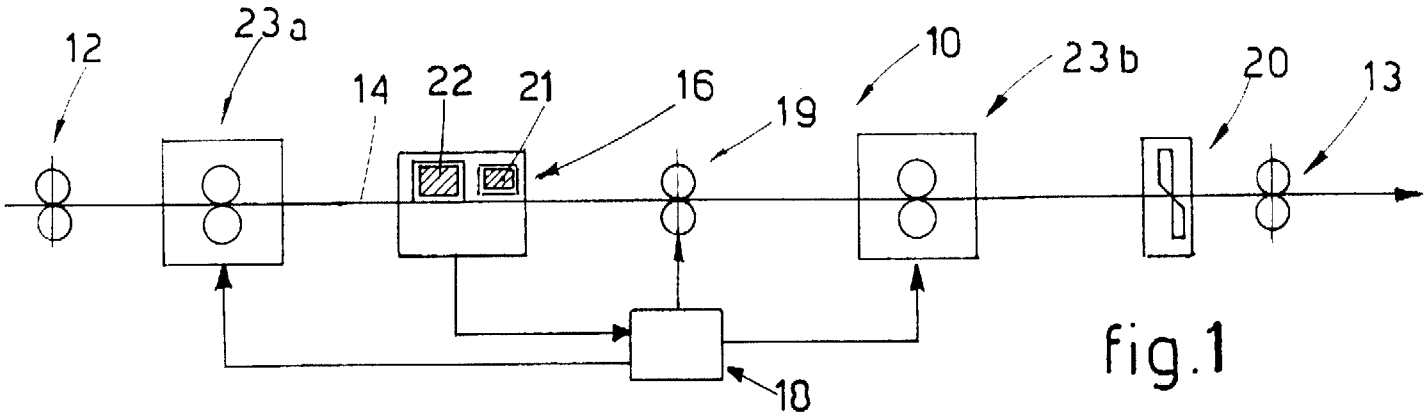
FIG. 1 shows a first solution of the invention
Figure 2:
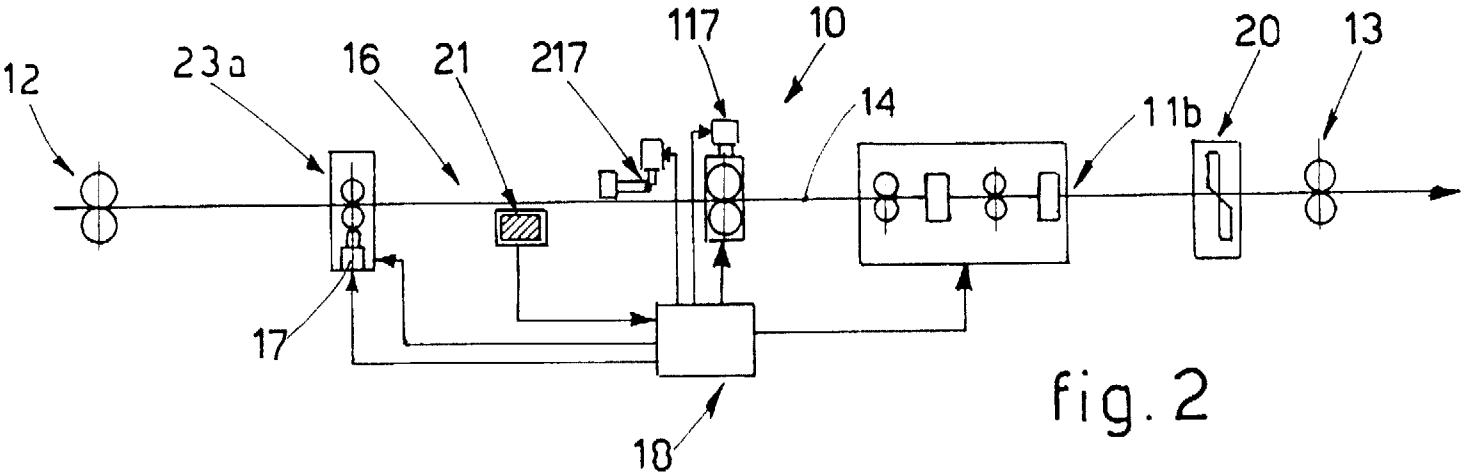
FIG. 2 shows a variant of FIG. 1.

In the example of FIG. 1 there are two conventional rolling stands 23*a* and 23*b* respectively, whereas in FIG. 2 a conventional rolling stand 23*a* cooperates with a fast rolling block 11*b*.

Figure 3:
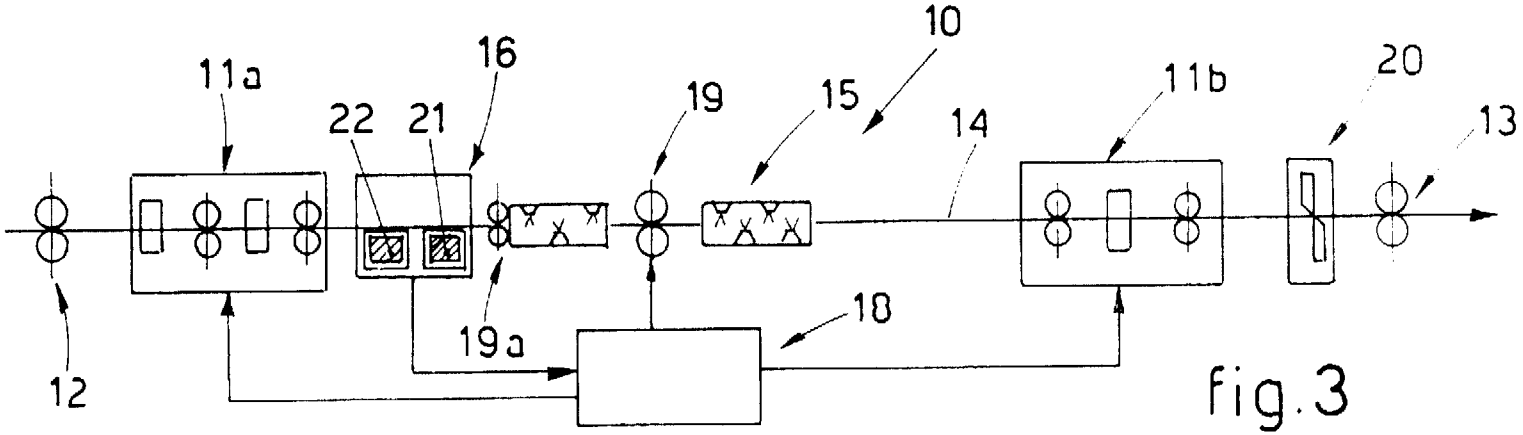
FIG. 3 shows another variant of FIG. 1.

In FIG. 3 there are two fast rolling blocks, respectively 11*a* and 11*b*.

Downstream of the downstream rolling unit, 23*b* or 11*b*, there are shears 20 for shearing to size and a discharge drawing unit 13, while upstream of the upstream rolling unit, 23*a* or 11*a*, there is an intake drawing unit 12.

In this case a measurement device 16 is included between the first 11*a*, 23*a* and the second 11*b*, 23*b* rolling units and is suitable to detect the value of the drawing force exerted on the rolled stock 14.

The measurement means 16 is associated with an actuation and control unit 18, which has the appropriate means to intervene in feedback on the working parameters of the rolling stand 23*b* and/or the stand 23*a*, and, to be more exact, on the motors driving the rolls if the drawing action thus measured does not correspond to the pre-set values, so that there are not induced in the rolled stock 14 excessive deformations and reductions of cross-section outside the pre-set limits, and/or if the drawing force thus measured takes on characteristics which are not uniform and constant in the long term.

In the example shown in FIG. 1 the measurement device 16 is composed of a unit 22 to generate electromagnetic impulses and a unit 21, arranged immediately downstream of unit 22, to detect the parameters of the frequency and amplitude of the vibrations and oscillations induced on the portion of rolled stock 14 passing through, which goes from the stand 23*a* to the drawing unit 19.

In particular, the electromagnetic impulse generator unit 22 emits an impulse field which causes in the rolled stock 14 passing through at high speed a transverse oscillation which is characterised by defined parameters of frequency and amplitude, which are strictly correlated to the value of tension, and therefore of drawing force, on the rolled stock 14 in that segment.

In particular, this transverse oscillation is defined by at least a characteristic frequency which gives strict and extremely precise information on the state of tension of the rolled stock 14 at the point and at the moment when these impulses are applied.

To achieve this solution and to ensure its accuracy and reliability, a drawing unit 19 is included advantageously downstream of the measurement device 16 and has the purpose of defining an exact length of the portion of rolled stock 14 under observation, this parameter of length conditioning the value of frequency and amplitude of the vibrating rolled stock Moreover, this drawing unit 19, by maintaining in the right direction the section of rolled stock 14 between the two measurement extremes given by the stand 23*a* and the drawing unit 19, prevents or at least considerably limits the possibility that the segment of rolled stock 14 might contact guide and containment elements and/or other elements arranged about the path of the rolled stock 14, for such elements could alter the precision and accuracy of the determination of the vibration parameters.

The detecting unit 21 is associated with the actuation and control unit 18, which, with its own calculation means, and from the frequency value detected, calculates the value of the drawing force exerted on the rolled stock.

It is known that there is a precise relation linking the frequency of the vibration, given the length of a bar, with its tension.

In the event that the value of the drawing force is found to be not compatible with the pre-set limit values, the control unit 18 intervenes on the working parameters of the stand 23*a* and/or 23*b* so as to correct the drawing force according to the pre-set values.

In the variant shown in FIG. 2, the vibration is generated on the rolled stock 14 by means of a mechanical action, that is by means of a repeated impact with parameters of intensity and frequency which can be determined beforehand.

In this case too the detecting unit 21 detects the parameters of frequency and amplitude of the vibrations in the rolled stock 14 passing through and transmits those parameters to the actuation and control unit 18, which calculates the value of tension, i.e., the drawing force on the rolled stock 14 and possibly takes corrective action in feedback on the working parameters of the fast rolling block 11*a* and/or of the stand 23*a*.

In one embodiment of the invention the impact is imparted to the upstream rolling stand 23*a* by suitable means referenced with 17, which in this case consist of a jack screw associated with the pair of rolls.

According to a variant the impact is imparted to the drawing unit 19 by means referenced with 117.

According to another variant the impact is imparted directly to the rolled stock 14 by means referenced with 217.

Simultaneous actions of the means 26, 126 and 226 may also be carried out.

According to a further variant not shown here, no action of an impulse type is exerted on the section of rolled stock 14 as it passes through, the detecting unit 21 measuring in this case the parameters of the natural vibration of the section of rolled stock 14 included between the upstream rolling unit, 23*a* or 11*a*, and the drawing unit 19.

In the embodiment shown in FIG. 3, the segment 10 of line consists of a finishing train which includes a fast semi-finishing rolling block 11*a* and a fast finishing rolling block 11*b*, between which there is a cooling device with jets of water 15 which performs a desired thermomechanical treatment of the rolled stock 14.

The cooling device 15 using jets of water is structured with two blocks, between which is positioned a drawing unit 19.

In the case of FIG. 3, the measuring device 16 comprises an impulse generator 22 and a device 21 to detect vibrations.

In this case, advantageously, there is a drawing unit 19*a* also upstream of the cooling device 15 using water jets, for the reasons mentioned above with reference to the case as in FIG. 2.

I claim:

1. A method to control the drawing of a length of rolled stock in a segment of a rolling line, the segment comprising a rolling unit with a drawing unit or comprising two rolling units, the method comprising measuring a tension force applied to the rolled stock in the segment between stands comprised between two rolling units, one upstream and the other downstream and/or between the rolling unit and the relative drawing unit, comprising the steps of:

measuring at least one vibration parameter selected from a frequency and an amplitude of a transverse vibration of the length of rolled stock;

determining in correspondence with the measured parameter a value of the tension force acting on the length of the rolled stock;

comparing the determined value of the tension force to a reference value and determining a corresponding correction; and applying the correction to maintain the tension force at a substantially constant value.

2. Method as in claim 1, in which an action of an impulse type is carried out on the segment of the rolled stock between stands, in such a way that the vibration of the rolled stock itself is accentuated.

3. Method as in claim 2, in which the action of an impulse type is generated by application of a magnetic impulse field with a vibrating effect on the rolled stock.

4. Method as in claim 2, in which the action of an impulse type is generated by application of a mechanical impact with a vibrating effect on the rolled stock.

5. Method as in claim 4, in which the mechanical impact is applied directly to the rolled stock passing through.

6. Method as in claim 4, in which the mechanical impact is applied on one of the rolling units and/or on one of the drawing units associated with the rolled stock passing through.

7. A device to control the drawing of a length of rolled stock in a segment of a rolling line comprising one of a rolling unit cooperating with a drawing unit or two cooperating rolling units, the device being characterized in that there is also included at least between the upstream rolling unit and the downstream rolling unit and/or the drawing unit a measurement device to measure the drawing force imparted to the rolled stock in the segment, the measurement device comprising at least:

a detecting unit to detect and measure a vibration parameter comprising at least one of a frequency and an amplitude of a transverse vibration of the length of rolled stock;

means for correlating the at least one of the frequency or amplitude a corresponding value of a drawing force being exerted on the rolled stock; and means for correcting, by feedback, working parameters of the downstream rolling unit or drawing unit and/or the upstream rolling unit for maintaining the drawing force to a substantially constant value.

8. Device as in claim 7, in which the measurement device comprises a unit generating a vibration of the rolled stock and associated with a detecting unit.

9. Device as in claim 8, in which the unit generating a vibration of the rolled stock comprises a unit generating a magnetic impulse field.

10. Device as in claim 8, in which the unit generating a vibration of the rolled stock comprises a unit generating a mechanical impact that affects the rolled stock itself.

11. Device as in claim 10, in which the mechanical impact is applied directly to the rolled stock by impact means.

12. Device as in claim 10, in which the mechanical impact is applied to a rolling unit and/or to the drawing unit in the vicinity of the rolled stock.

13. Device as in any of claims 7, in which the detecting unit to measure the parameters of frequency and/or amplitude of the vibrations of the rolled stock cooperates downstream with a drawing unit in determining an accurate value of length of the section of rolled stock under observation and in preventing contact of the rolled stock with drawing and guide elements arranged around the path of the rolled stock.

* * * * *